US005674093A

United States Patent [19]

Vaden

[11] Patent Number: 5,674,093

[45] Date of Patent: Oct. 7, 1997

[54] REDUCED CROSS TALK ELECTRICAL CONNECTOR

[75] Inventor: Sterling A. Vaden, Black Mountain, N.C.

[73] Assignee: Superior Modular Process Incorporated

[21] Appl. No.: 685,167

[22] Filed: Jul. 23, 1996

[51] Int. Cl.[6] ..... H01R 23/02

[52] U.S. Cl. ..... 439/676; 439/941

[58] Field of Search ..... 439/676, 941, 439/344, 60, 630, 636, 637, 924.1, 924.2

[56] References Cited

U.S. PATENT DOCUMENTS

| | | | |
|---|---|---|---|
| 4,274,691 | 6/1981 | Abernethy et al. | 439/676 |
| 4,406,509 | 9/1983 | Jagen | 439/344 |
| 4,941,830 | 7/1990 | Tkazyik et al. | 439/630 |
| 5,052,936 | 10/1991 | Biechler et al. | 439/60 |
| 5,299,956 | 4/1994 | Brownell et al. | 439/638 |
| 5,387,135 | 2/1995 | Shen et al. | 439/676 |
| 5,399,107 | 3/1995 | Gentry et al. | 439/676 |

OTHER PUBLICATIONS

"Category 5 Performance Modular Plug and Jack System", issued 1995, *Stewart Connector*.

*Primary Examiner*—Gary F. Paumen
*Assistant Examiner*—Tho D. Ta
*Attorney, Agent, or Firm*—Carter & Schnedler

[57] ABSTRACT

There is provided an electrical connector, including a housing which receives a plurality of elongated contacts for receiving electrical signals. Each contact includes a free end. Each contact having a major bend therein. At least a portion of adjacent contacts between their respective free ends and major bends are not parallel so that electrical signal transmission of the connector is enhanced.

14 Claims, 3 Drawing Sheets

*Prior Art*

REDUCED CROSS TALK ELECTRICAL CONNECTOR

BACKGROUND OF THE INVENTION

This invention relates to reducing electrical signal interference which arises electrical connectors having closely spaced contacts. More particularly it relates to the reduction of cross talk induced by closely spaced contacts in Federal Communications Commission (FCC) type modular jacks and plugs and other signal connectors.

The FCC has adopted certain architectural standards with respect to electrical connectors utilized in the telecommunication industry so as to provide intermatability. The connectors that are most commonly utilized are FCC type modular plugs and jacks. The plug is commonly terminated to a plurality of wires which may be connected to a telephone handset or other communication device. The corresponding jack is commonly mounted to a panel or printed circuit board which in turn is connected to a telecommunication network.

A typical FCC jack is described in U.S. Pat. No. 4,648,678 issued to Archer. The Archer jack includes a plurality of closely spaced parallel electrical contacts. Typically, the closely spaced parallel contacts are mounted to a nose piece as shown in FIG. 1. Nose piece 10 includes a plurality of contacts 12 mounted thereto. Contacts 12 are divided into pairs forming so-called signal pairs. Because these contacts are so closely spaced due to FCC constraints and are parallel to one another, pair to pair cross talk is induced. This cross talk is primarily due to capacitive and inductive couplings between adjacent conductors. Since the extent of the cross talk is a function of the frequency of the signal on a pair, the magnitude of the cross talk is logarithmically increased as the frequency increases and is commonly expressed as ten times the log of the ratio of the cross talk energy divided by the signal energy (decibels or DB).

As FCC modular jacks and plugs are utilized more in high frequency data and communication applications, cross talk, which arises in adjacent and parallel contacts within the jack, has become an industry problem. U.S. Pat. No. 5,299,956 issued to Brownell and Vaden, and assigned to Superior Modular Products, Inc., assignee of this invention, teaches the cancellation of the cross talk arising in the jack by utilizing a capacitance formed on the circuit board which is connected to the jack. U.S. Pat. No. 5,186,647 issued to Denkmann et al teaches of the reduction of cross talk in an electrical connector by crossing over conductors of a lead frame in an electrical connector.

While the Brownell/Vaden and the Denkmann approaches to cross talk reduction have significantly reduced cross talk and have met with substantial commercial success, there remains a need to further enhance the performance of FCC type connectors, particularly as frequencies increase.

U.S. Pat. No. 5,399,107 issued to Gentry et al shows a modular jack which achieves enhanced cross talk performance by utilizing alternating long and short electrical contacts so that not all portions of the adjacent contacts are immediately adjacent. The alternating Gentry contacts are illustrated in a simplified form in FIG. 2 as short contact 60 and long contact 62. However, the resiliency of the short contact 60 of Gentry is compromised due to its length.

Stewart Stamping Company sells a reduced cross talk connector where the reduction is achieved by the configuration of adjacent contacts, however, the adjacent contacts do not have major first bends in the same direction like the typical contacts shown in FIG. 1. In addition, the Steward design reduces longitudinal balance.

OBJECTS OF THE INVENTION

It is therefore one object of this invention to provide a low cross talk electrical signal transmission system.

It is another object to provide an electrical connector which is designed to reduce cross talk between signal pairs.

It is another object to provide a reduced cross talk electrical connector which does not degrade longitudinal balance.

It is yet another object to provide contacts for a reduced cross talk electrical connector where the resiliency of the contacts are not compromised.

SUMMARY OF THE INVENTION

In accordance with one form of this invention, there is provided an electrical connector including a housing which receives a plurality of elongated contacts. The contacts are adapted to receive electrical signals. The plurality of contacts includes a first contact and a second contact which are adjacent to one another. Each contact includes a first bend defining upper and lower portions of the contact. At least a part of the upper portion of the first contact is not parallel to a part of the upper portion of the second contact, whereby electrical signal transmission characteristics of the connector is enhanced.

Preferably the first contact has a second bend which is curved in the reversed direction from the first bend. It is also preferred that each of the contacts are substantially the same length. Preferably the lengths of each contact are substantially the same so as to not degrade longitudinal balance.

Also preferably, the first contact includes a third bend which is curved in the same direction as the first bend. Thus, a substantial portion of adjacent contacts are maintained a distance from one another and are not parallel to one another so that capacitive coupling is reduced. Also it is preferred that the alternate contacts are the same shape, which will further enhance cross talk reduction due to a capacitive decoupling affect between such contacts.

BRIEF DESCRIPTION OF THE DRAWINGS

The subject matter which is regarded as the invention is set forth in the appended claims. The invention itself, however, together with further objects and advantages thereof may be better understood in reference to the accompanying drawings in which:

DESCRIPTION OF THE PREFERRED EMBODIMENT

Figure 3:
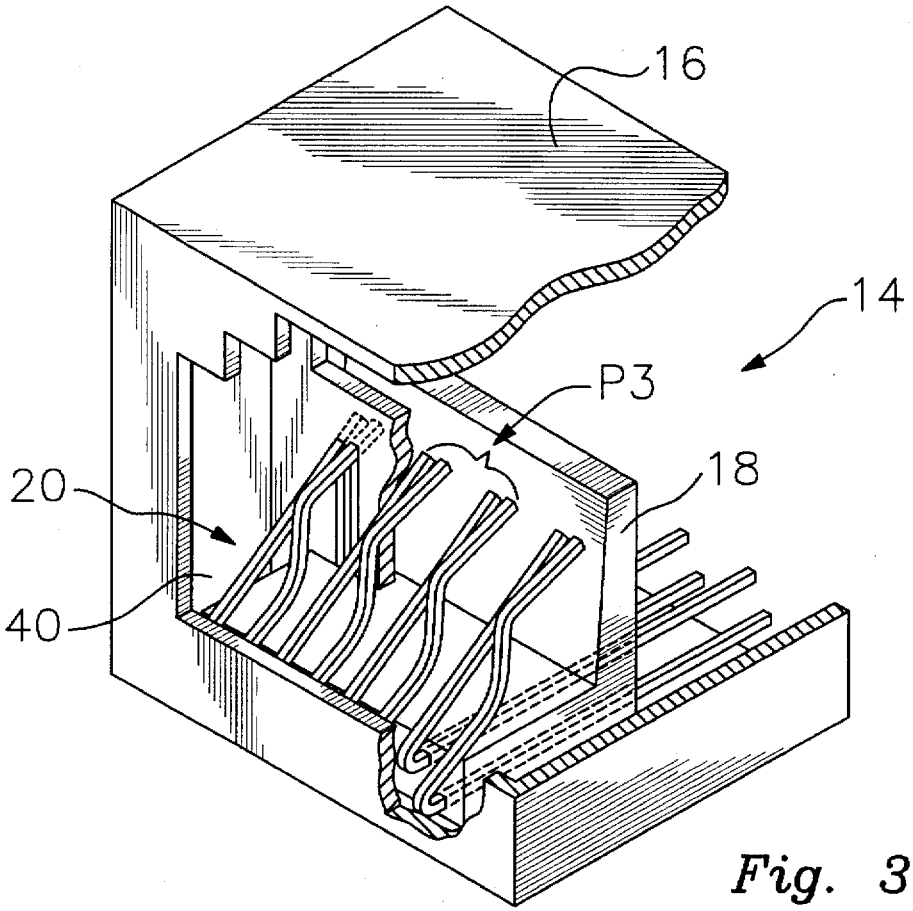
FIG. 3 is a partial pictorial view of the apparatus of the subject invention.

Referring now more particularly to FIG. 3, there is provided FCC type modular jack 14 including a housing 16 and a contact carrier 18. In this embodiment eight spring contacts 20 are mounted on contact carrier 18. It is preferred that the contacts be made of copper alloy or bronze alloy.

Figure 4:
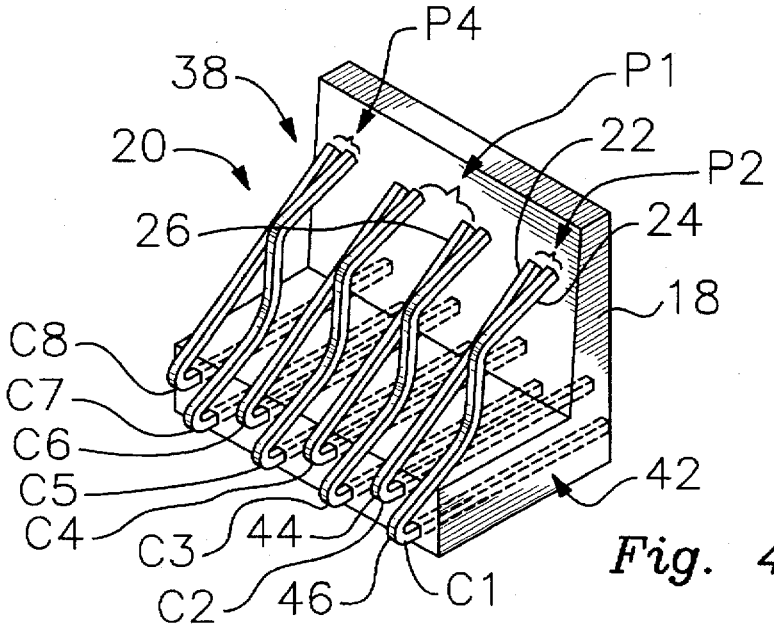
FIG. 4 is a pictorial view of the contact carrier and contacts of the embodiment of FIG. 3.
Figure 5:
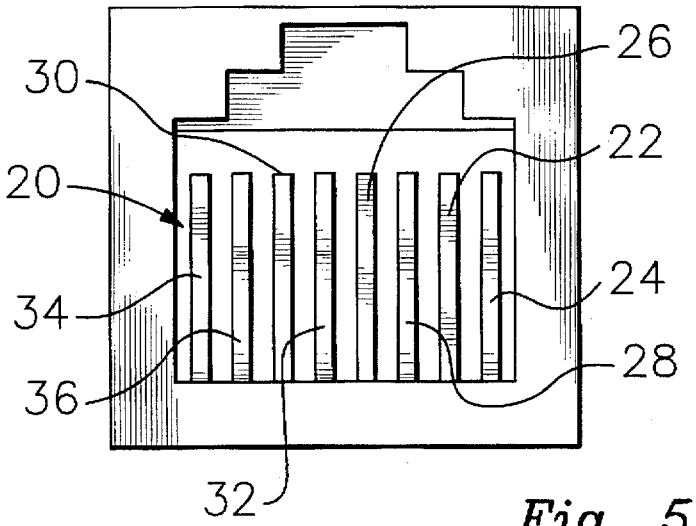
FIG. 5 is a front elevational view of the embodiment of FIG. 3.

The relationship between the contact carrier 18 and the contacts 20 is better shown in reference to FIGS. 4 and 5. Contacts 22, 24, 26, 28, 30, 32, 34 and 36 are closely spaced electrical spring contacts which make contact with fixed contacts in a corresponding FCC type modular plug (not shown). Certain pairs of these contacts forms parts of electrical circuits.

The contacts 20 include deflectable upper portions 38 which provide forces on the corresponding contacts in the plug when the plug is inserted into the opening 40 of housing 16. The contacts 20 also include lower substantially fixed portions 42, two conductors of which are shown as dotted lines in FIG. 4 for illustration purposes. The lower portions are held together in contact carrier 18. The contacts 22 through 36 include alternating adjacent contacts made of two different designs in the upper regions 38 thereof.

Figure 1:
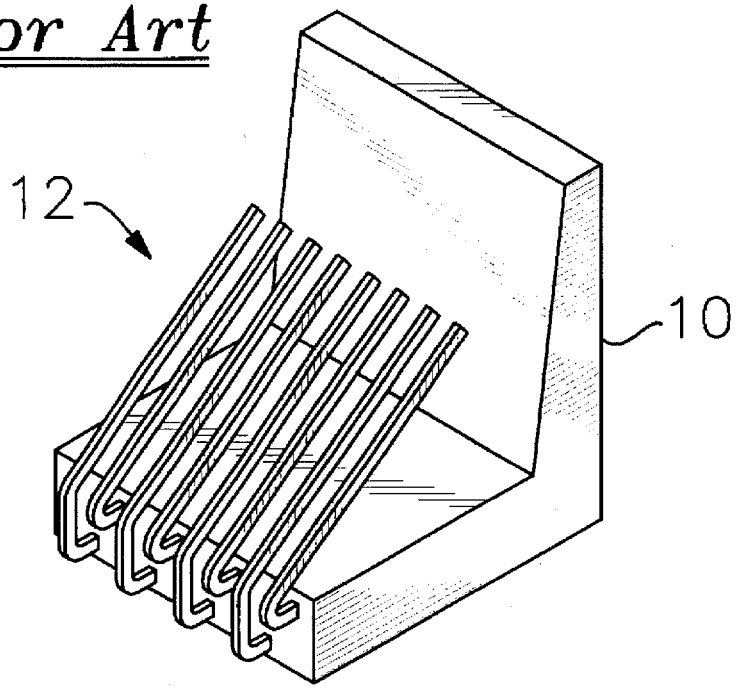
Fig. 1 Prior Art
FIG. 1 is a pictorial view of a contact carrier and associated contacts from a prior art electrical connector.
Figure 2:
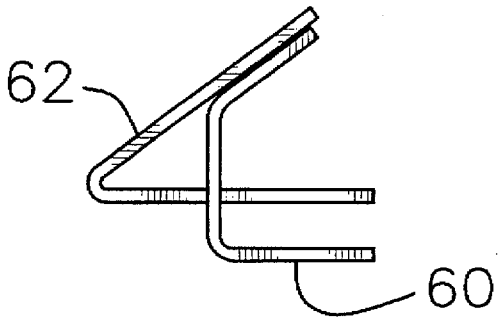
FIG. 2 is a side elevational view showing a pair of adjacent contacts from another prior art electrical connector.

Contacts 22, 26, 30 and 34 form one group of contacts and are of a standard design similar to contacts 12 shown in FIG. 1. That is, contacts 22, 26, 30 and 34 include a single major, first bend 44 as best shown in FIGS. 7 and 8.

Figure 6:
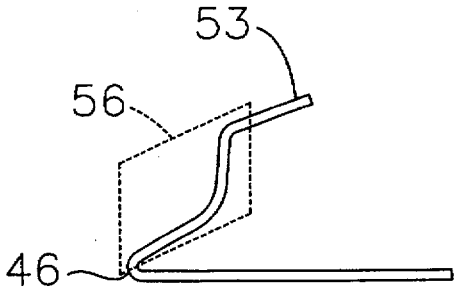
FIG. 6 is a side elevational view of one of the contacts from FIG. 4 having a reverse bend with a dotted line box showing the region of the contact which is not parallel and closely spaced to its adjacent contact.
Figure 8:
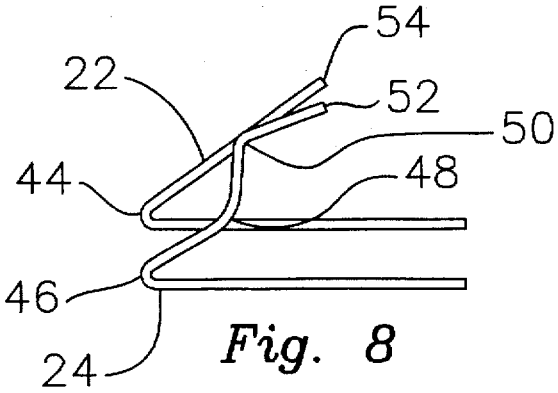
FIG. 8 is a side elevational view of a pair of adjacent contacts from the embodiment of FIG. 3.

Contacts 24, 28, 32 and 36 form another group of contacts and are designed with three bends which are best seen in reference to FIGS. 6 and 8. Contacts 22, 26, 30 and 34 have a different profile from contacts 24, 28, 32 and 36. Contact 24 which is identical to contacts 28, 32 and 36 includes a first bend 46 which is similar to bend 44 of contact 26. Contact 24 further includes a second bend 48 which is curved in the reverse direction from first bend 46. Contact 24 further includes a third bend 50 which is curved in the same direction as first bend 46. The upper portion of contact 24 presents somewhat of a "S" shaped profile.

The portions of both contacts 24 and 26 near their respective free ends 52 and 54 make contact with the associated plug contacts (not shown).

Figure 7:
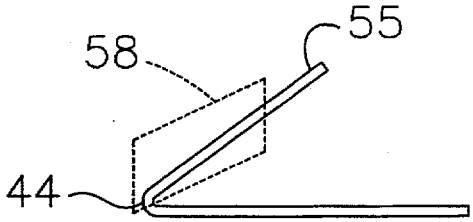
FIG. 7 is a side elevational view of another of the contacts from FIG. 4, which is adjacent to the contact shown in FIG. 6 with a dotted line box showing the region of the contact which is not parallel and closely spaced to its adjacent contact.

As can be seen better by reference to FIGS. 6, 7 and 8, there are regions in the upper portions of the contacts 24 and 26 between the respective bends 44 and 46, and the plug contact making portions of 53 and 55 which are not closely spaced and are not parallel to one another. Those regions are illustrated by dotted rectangular boxes 56 and 58.

Figure 9:
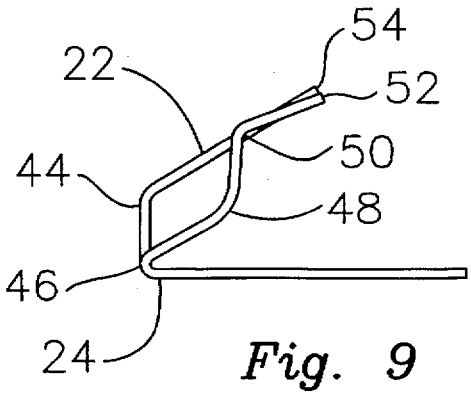
FIG. 9 is a side elevational view of a pair of adjacent contacts showing an alternative embodiment to FIG. 8.

The contact pair shown in FIG. 9 is substantially identical to those shown in FIG. 8, except that the lower portions of the two contacts are in the same plane.

It has been found by utilizing alternating contacts 24, 28, 32 and 36 contain the additional two bends 48 and 50 adjacent to standard contacts 22, 26, 30 and 34, cross talk which occurred in the prior art connector shown in FIG. 1 has been substantially reduced. Near end cross talk measurements at 100 MHz have been taken for this improved design connector, comparing the results directly to results from the conventional connector of the type shown in FIG. 1 having otherwise substantially the identical basic construction. The measurements were taken in accordance with the arrangement set forth below.

Printed Circuit Board Arrangement of Conductors

| Pair Number | Conductor Numbers | Pair Combination | Primary NEXT Contributors (Conductor #s) |
|---|---|---|---|
| P1 | C4–C5 | P1–P2 | C2–C4 |
| P2 | C1–C2 | P1–P3 | C3–C4 and C5–C6 |
| P3 | C3–C6 | P1–P4 | C5–C7 |
| P4 | C7–C8 | P2–P3 | C2–C3 |
| | | P2–P4 | C2–C7 |
| | | P3–P4 | C6–C7 |

The connector tested was constructed substantially similarly to the connector shown in FIGS. 3 and 4, although, the alternating S curved and straight conductor contacts were reversed. That is, the connector tested was designed with conductor contacts C2, C4, C6 and C8 having the S curved conductor contacts for cross talk reduction. However, for ease of illustration and understanding, the test results will be described in reference to the connector construction shown in FIGS. 3 and 4. The cross talk occurs between conductors C2 and C3, conductors C4 and C3, conductors C5 and C6, and conductors C6 and C7. The cross talk reduction appears on pairs P2–P3, P1–P3, P2–P4, and P3–P4. The other pair combinations are relatively unaffected. This is confirmed by the test data, where each pair combination was tested with five different modular plugs numbered Pg1 through Pg5. Five plugs were used to confirm NEXT improvement across a range of plugs with differing NEXT values.

The results of the measurements in DB are shown in the tables set forth below:

Near End Cross Talk
Category 5 @ 100 MHz
Prior Art vs. Invention

| | Prior Art | Invention |
|---|---|---|
| Pairs 1–3 | | |
| Pg1 | −33.82 DB | −36.38 DB |
| Pg2 | −34.13 | −36.98 |
| Pg3 | −34.44 | −37.20 |
| Pg4 | −37.10 | −41.02 |
| Pg5 | −37.33 | −41.28 |
| Pairs 2–3 | | |
| Pg1 | −49.72 DB | −56.87 DB |
| Pg2 | −47.87 | −52.86 |
| Pg3 | −54.20 | −60.15 |
| Pg4 | −45.09 | −49.18 |
| Pg5 | −46.26 | −50.09 |
| Pairs 2–4 | | |
| Pg1 | −63.73 DB | −65.59 DB |
| Pg2 | −66.52 | −69.70 |
| Pg3 | −64.82 | −66.68 |
| Pg4 | −66.65 | −69.05 |
| Pg5 | −66.36 | −69.63 |
| Pairs 3–4 | | |
| Pg1 | −52.98 DB | −56.21 DB |
| Pg2 | −48.82 | −53.18 |
| Pg3 | −53.09 | −57.01 |
| Pg4 | −49.48 | −54.20 |
| Pg5 | −46.34 | −49.79 |

The improvement for pairs P1–P3, P2–P3, and P3–P4 are particularly notable. Thus, within experimental variation, the improvement in NEXT improves as a function of plug NEXT across all five plugs for pairs P1–P3, P2–P3, P2–P4, and P3–P4, as summarized below.

| Pair Combination | Primary NEXT Contributors (Conductor #s) | Reverse Curve Conductor # | Resulting NEXT Reduction |
|---|---|---|---|
| P1–P3 | C3–C4 and C5–C6 | C3, C5 | 2.5 to 3.9 DB |
| P2–P3 | C2–C3 | C3 | 3.5 to 7 DB |
| P2–P4 | C2–C7 | C7 | 2–3 DB |
| P3–P4 | C6–C7 | C7 | 3.2 to 4.7 DB |

In addition, due to the two extra bends 48 and 50 in contact 24, the lengths of each contact are substantially equal so that the longitudinal balance as described in CCITT recommendations 0.9 is preserved.

From the foregoing description of the preferred embodiment of the invention, it will be apparent that many modifications may be made therein. It will be understood, however, that this embodiment of the invention in an exemplification of the invention only and that the invention is not limited thereto. It is to be understood therefore that it is intended in the appended claims to cover all modifications as fall within the true spirit and scope of the invention.

I claim:

1. An electrical connector comprising:

a housing;

said housing receiving a plurality of elongated contacts;

said contacts adapted to receive electrical signals;

said plurality of contacts including a first contact and a second contact; said first contact adjacent to said second contact;

each contact including a first bend defining an upper and lower portions of said contact;

at least a part of said upper portion of said first contact not being parallel to at least a part of said upper portion of said second contact, whereby electrical signal transmission characteristics of said connector is enhanced;

said first contact includes a second bend in said upper portion;

said second bend being curved in a reverse direction from said first bend;

said second bend forming a part of said upper portion of said first contact which is not parallel to a part of said upper portion of said second contact.

2. A connector set forth in claim 1, wherein said first bend of said first contact has a shorter radius than said first bend of said second contact.

3. A connector as set forth in claim 1, wherein said first and second contacts are substantially the same length.

4. A connector is set forth in claim 1, further including third and fourth contacts;

said third contact being substantially identical to said first contact;

said fourth contact being substantially identical to said second contact;

said third contact being located between said second and fourth contacts.

5. A connector as set forth in claim 4, wherein an amount of cross talk cancellation occurs between said first and third contacts and between said second and fourth contacts when signals exists on said first, second, third and fourth contacts.

6. A connector as set forth in claim 1, wherein said first contact includes a third bend in said upper portion;

said third bend being curved in the same direction as said first bend.

7. A connector as set forth in claim 6, wherein said third bend forms a part of the upper portion of said first contact which is not parallel to a part of said upper portion of said second contact.

8. An electrical connector comprising:

a housing;

said housing receiving a plurality of elongated contacts;

said contacts adapted to receive electrical signals;

said plurality of contacts including a first contact and a second contact;

said first contact adjacent to said second contact;

each contact including a first bend defining an upper and lower portions of said contact;

at least a part of said upper portion of said first contact not being parallel to at least a part of said upper portion of said second contact, whereby electrical signal transmission characteristics of said connector is enhanced;

the upper portion of said first contact is substantially in the form of a "S".

9. An electrical connector comprising a housing;

said housing receiving a plurality of elongated contacts;

said contacts adapted to receive electrical signals;

each of said contacts including a first bend defining a deflection portion and a substantially fixed portion;

said contacts including first and second groups;

said first group of contacts having a profile which is substantially different from the profile of said second group;

said contacts forming a row with the contacts in said first group alternating with said contacts in said second group, wherein said contacts in said first group are adjacent to said contacts in said second group;

said deflection portion of said contacts of said first group having a substantially "S" shape profile;

said deflection portion of the contacts of said second group being substantially straight, whereby at least a part of the deflection portion of adjacent contacts are not parallel to one another.

10. A connector as set forth in claim 9, wherein said first bend in each of said contacts of said first group of contacts has a shorter radius than said first bend in each of said contacts of said second group of contacts.

11. A connector as set forth in claim 9, wherein said first group of contacts and said second group of contacts are substantially the same length.

12. A connector as set forth in claim 9, wherein an amount of cross talk cancellation occurs in the deflection portions of adjacent contacts.

13. A connector as set forth in claim 9, wherein said deflection portion of said first group of contacts includes a second bend;

said second bend being curved in a reverse direction from said first bend.

14. A connector as set forth in claim 13, wherein said deflection portion of said first group of contacts includes a third bend;

said third bend being curved in the same direction as said first bend.

* * * * *

UNITED STATES PATENT AND TRADEMARK OFFICE

CERTIFICATE OF CORRECTION

PATENT NO. : 5,674,093

DATED : October 7, 1997

INVENTOR(S) : Sterling A. Vaden

It is certified that error appears in the above-indentified patent and that said Letters Patent is hereby corrected as shown below:

On the cover sheet, adjacent to "Assignee:", "Superior Modular Process Incorporated" should read "Superior Modular Products Incorporated".

Signed and Sealed this

Ninth Day of December, 1997

*Attest:*

Bruce Lehman

BRUCE LEHMAN

*Attesting Officer*

*Commissioner of Patents and Trademarks*